US008752382B2

(12) United States Patent
Lehar

(10) Patent No.: US 8,752,382 B2
(45) **Date of Patent: *Jun. 17, 2014**

(54) DUAL REHEAT RANKINE CYCLE SYSTEM AND METHOD THEREOF

(71) Applicant: General Electric Company, Schenectady, NY (US)

(72) Inventor: Matthew Alexander Lehar, Munich (DE)

(73) Assignee: General Electric Company, Niskayuna, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/826,414

(22) Filed: Mar. 14, 2013

(65) Prior Publication Data

US 2013/0199184 A1 Aug. 8, 2013

Related U.S. Application Data

(63) Continuation of application No. 12/567,894, filed on Sep. 28, 2009, now Pat. No. 8,459,029.

(51) Int. Cl.
*F01K 25/08* (2006.01)
*F01K 7/00* (2006.01)

(52) U.S. Cl.
USPC ..... 60/651; 60/671; 60/645

(58) Field of Classification Search
USPC ..... 60/651, 671, 676, 679
See application file for complete search history.

(56) References Cited

U.S. PATENT DOCUMENTS 4,765,143 A 8/1988 Crawford et al.
4,995,234 A 2/1991 Kooy et al.

(Continued)

FOREIGN PATENT DOCUMENTS

CN 1940254 A 4/2007
CN 1954134 A 4/2007

(Continued)

OTHER PUBLICATIONS

Oh et al., "Development of a Supercritical Carbon Dioxide Brayton Cycle: Improving PBR Efficiency and Testing Material Compatibility", Project No. 02-190, Nuclear Energy Research Initiative Report for Oct. 2004 to Sep. 2004, INEEL/EXT-04-02437, 38 pages, 2004.

(Continued)

*Primary Examiner* — Thomas Denion
*Assistant Examiner* — Steven D Shipe
(74) *Attorney, Agent, or Firm* — Andrew J. Caruso

(57) ABSTRACT

A rankine cycle system includes a heater configured to circulate a working fluid in heat exchange relationship with a hot fluid to vaporize the working fluid. A hot system is coupled to the heater. The hot system includes a first heat exchanger configured to circulate a first vaporized stream of the working fluid from the heater in heat exchange relationship with a first condensed stream of the working fluid to heat the first condensed stream of the working fluid. A cold system is coupled to the heater and the hot system. The cold system includes a second heat exchanger configured to circulate a second vaporized stream of the working fluid from the hot system in heat exchange relationship with a second condensed stream of the working fluid to heat the second condensed stream of the working fluid before being fed to the heater.

20 Claims, 3 Drawing Sheets

(56) References Cited

U.S. PATENT DOCUMENTS

Figure 1:
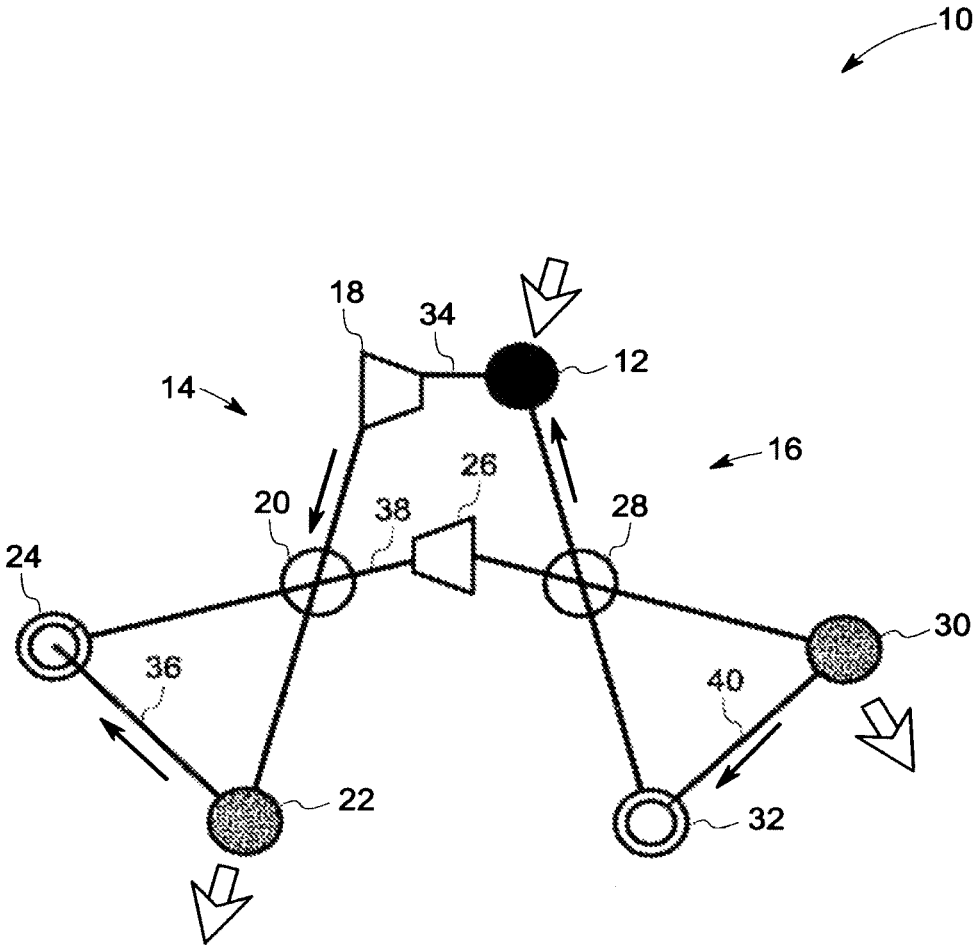

| | | | | |
|---|---|---|---|---|
| 6,170,264 | B1 | 1/2001 | Viteri et al. | |
| 6,945,029 | B2 | 9/2005 | Viteri | |
| 7,021,063 | B2 | 4/2006 | Viteri | |
| 7,096,665 | B2 * | 8/2006 | Stinger et al. | 60/651 |
| 7,340,897 | B2 | 3/2008 | Zimron et al. | |
| 7,658,072 | B2 | 2/2010 | Masada | |
| 7,942,001 | B2 | 5/2011 | Radcliff et al. | |
| 8,096,128 | B2 | 1/2012 | Held et al. | |
| 8,184,463 | B2 | 5/2012 | Saen et al. | |
| 2006/0048515 | A1 | 3/2006 | Zimron et al. | |
| 2010/0131918 | A1 | 5/2010 | Bailey et al. | |
| 2011/0113780 | A1 | 5/2011 | Lehar | |
| 2012/0125002 | A1 | 5/2012 | Lehar et al. | |
| 2012/0128463 | A1 | 5/2012 | Held | |
| 2012/0131918 | A1 | 5/2012 | Held | |

FOREIGN PATENT DOCUMENTS

| | | | |
|---|---|---|---|
| CN | 101248253 | A | 8/2008 |
| CN | 102575532 | A | 7/2012 |
| WO | 9825019 | A1 | 6/1998 |
| WO | WO9941490 | A1 | 8/1999 |

OTHER PUBLICATIONS

U.S. Appl. No. 61/243,200, filed Sep. 17, 2009, entitled "Heat Engine and Heat to Electricity System".

U.S. Appl. No. 61/417,775, filed Nov. 29, 2010, entitled "Heat Engines With Cascade Cycles".

Unofficial English translation of CN Office Action dated Jan. 23, 2014 from corresponding Application No. 201010508032.4.

* cited by examiner

DUAL REHEAT RANKINE CYCLE SYSTEM AND METHOD THEREOF

RELATED CASE

This disclosure claims priority from and is a Continuation of U.S. patent application Ser. No. 12/567,894 filed on Sep. 28, 2009, and incorporates by reference said application in its entirety.

BACKGROUND

The invention relates generally to rankine cycle systems, and more specifically to a dual reheat rankine cycle system and method thereof.

Many power requirements could benefit from power generation systems that provide low cost energy with minimum environmental impact and that may be readily integrated into existing power grids or rapidly sited as stand-alone units. Combustion engines such as micro-turbines or reciprocating engines generate electricity at lower costs using commonly available fuels such as gasoline, natural gas, and diesel fuel. However, atmospheric emissions such as nitrogen oxides (NOx) and particulates are generated.

One method to generate electricity from the waste heat of a combustion engine without increasing the consumption of fuel or the output of emissions is to apply a bottoming cycle. Bottoming cycles use waste heat from a heat source, such as an engine, and convert that thermal energy into electricity. Rankine cycles are often applied as the bottoming cycle for the heat source. Rankine cycles are also used to generate power from geothermal or industrial waste heat sources. A fundamental organic Rankine cycle includes a turbogenerator, a preheater/boiler, a condenser, and a liquid pump.

Such a cycle may accept waste heat at higher temperatures (e.g. above the boiling point of a working fluid circulated within the cycle) and typically rejects heat at reduced temperature to the ambient air or water. The choice of working fluid determines the temperature range and thermal efficiency characteristics of the cycle.

In one conventional rankine cycle system for higher-temperature and larger-size installations, steam is used as a working fluid. Steam can be heated to higher temperatures, capturing more of the exhaust energy, without breaking down chemically. Conversely, steam poses immense difficulties because of the tendency of steam to corrode cycle components and the requirement that steam be expanded to a near-vacuum condition to optimally deliver embodied energy. The substantially low condenser pressure necessitates not only elaborate means of removing non-condensable gases that leak into the system, but also large, expensive and slow-starting, expander stages and condenser units.

In another conventional rankine cycle system, carbon dioxide is used as a working fluid. Carbon dioxide may be heated super critically to higher temperatures without risk of chemical decomposition. Conversely, carbon dioxide has relatively low critical temperature. The temperature of a heat sink must be somewhat lower than the condensation temperature of carbon dioxide in order for carbon dioxide to be condensed into a liquid phase for pumping. It may not be possible to condense carbon dioxide in many geographical locations if ambient air is employed as a cooling medium for the condenser, since ambient temperatures in such geographical locations routinely exceed critical temperature of carbon dioxide.

It is desirable to have a more effective rankine cycle system and method thereof.

BRIEF DESCRIPTION

In accordance with one exemplary embodiment of the present invention, an exemplary rankine cycle system is disclosed. The rankine cycle system includes a heater configured to circulate a working fluid in heat exchange relationship with a hot fluid to vaporize the working fluid. A hot system is coupled to the heater. The hot system includes a first heat exchanger configured to circulate a first vaporized stream of the working fluid from the heater in heat exchange relationship with a first condensed stream of the working fluid to heat the first condensed stream of the working fluid. A cold system is coupled to the heater and the hot system. The cold system includes a second heat exchanger configured to circulate a second vaporized stream of the working fluid from the hot system in heat exchange relationship with a second condensed stream of the working fluid to heat the second condensed stream of the working fluid before being fed to the heater.

DRAWINGS

Figure 2:
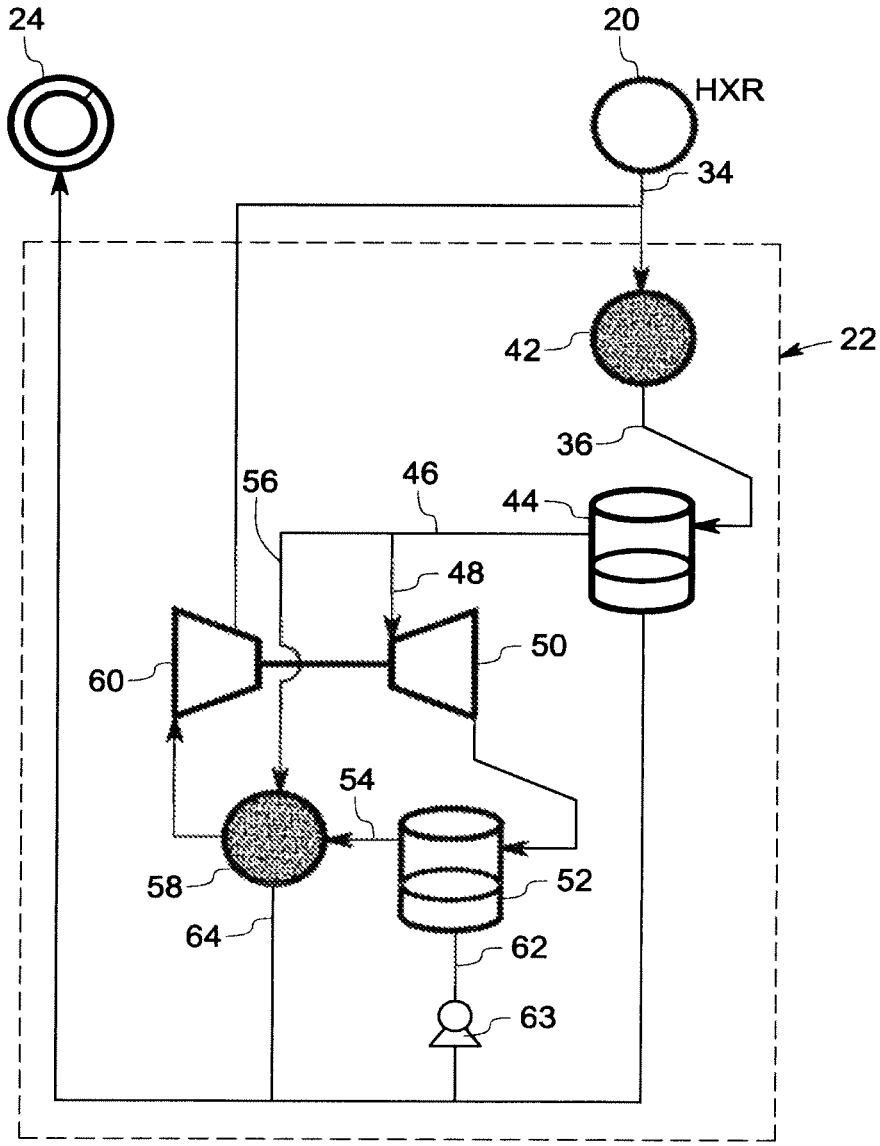
Figure 3:
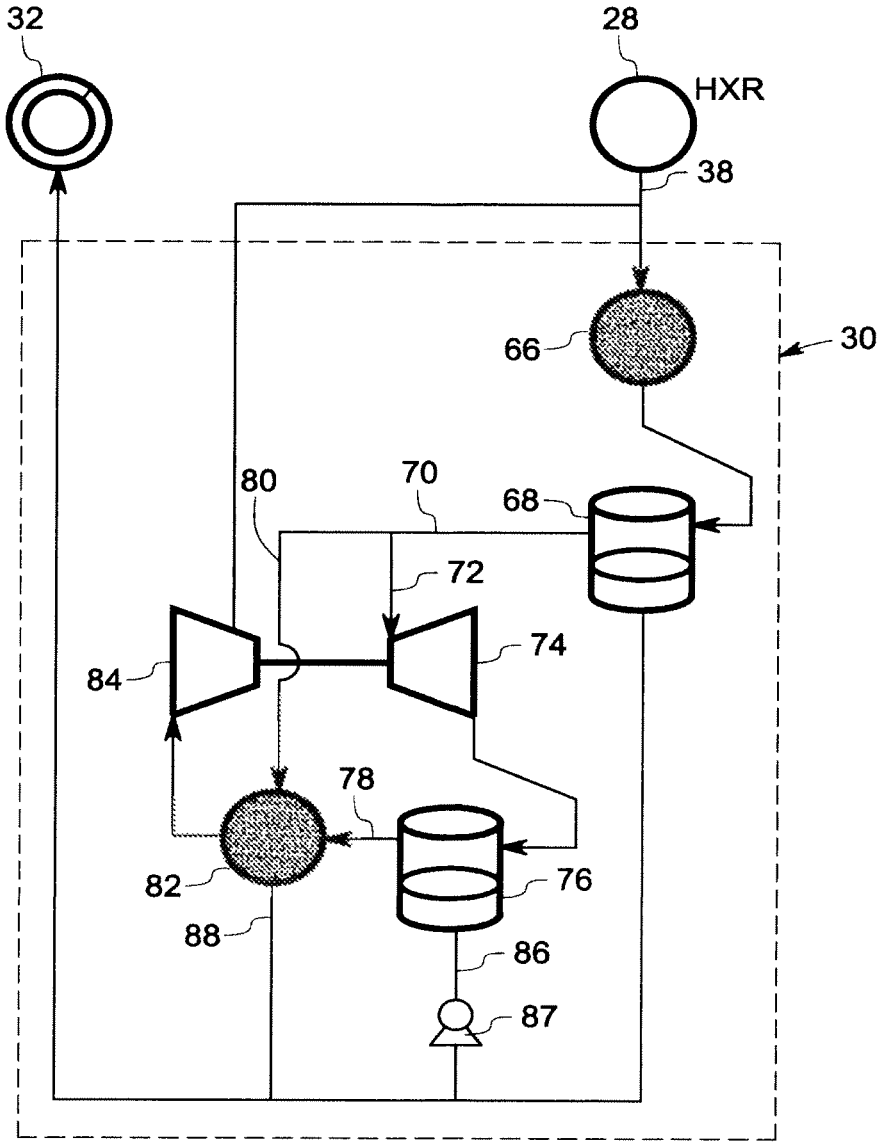

These and other features, aspects, and advantages of the present invention will become better understood when the following detailed description is read with reference to the accompanying drawings in which like characters represent like parts throughout the drawings, wherein:

FIG. 1 is a diagrammatical representation of a dual reheat rankine cycle system in accordance with an exemplary embodiment of the present invention, FIG. 2 is a diagrammatical representation of a portion of a hot system of a dual reheat rankine cycle system in accordance with an exemplary embodiment of the present invention; and FIG. 3 is a diagrammatical representation of a portion of a cold system of a dual reheat rankine cycle system in accordance with an exemplary embodiment of the present invention.

DETAILED DESCRIPTION

In accordance with the embodiments discussed herein, a dual reheat rankine cycle system is disclosed. The exemplary rankine cycle system includes a heater configured to circulate a working fluid in heat exchange relationship with a hot fluid so as to vaporize the working fluid. A hot system is coupled to the heater. The hot system includes a first heat exchanger configured to circulate a first vaporized stream of the working fluid from the heater in heat exchange relationship with a first condensed stream of the working fluid so as to heat the first condensed stream of the working fluid. A cold system is coupled to the heater and the hot system. The cold system includes a second heat exchanger configured to circulate a second vaporized stream of the working fluid from the hot system in heat exchange relationship with a second condensed stream of the working fluid so as to heat the second condensed stream of the working fluid before being fed to the heater. In accordance with the exemplary embodiments of the present invention, the rankine cycle system is integrated with heat sources to allow a higher efficient recovery of waste heat for generation of electricity. The heat sources may include combustion engines, gas turbines, geothermal, solar thermal, industrial and residential heat sources, or the like.

Referring to FIG. 1, a rankine cycle system 10 is illustrated in accordance with an exemplary embodiment of the present invention. The illustrated rankine cycle system 10 includes a heater 12, a hot system 14 and a cold system 16. A working fluid is circulated through the rankine cycle system 10. The hot system 14 includes a first expander 18, a first heat exchanger 20, a first condensing unit 22, and a first pump 24. The cold system 16 includes a second expander 26, a second heat exchanger 28, a second condensing unit 30, and a second pump 32.

The heater 12 is coupled to a heat source (not shown), for example an exhaust unit of a heat generation system (for example, an engine). The heater 12 receives heat from a hot fluid e.g. an exhaust gas generated from the heat source and heats the working fluid so as to generate a first vaporized stream 34 of the working fluid. In the hot system 14, the first vaporized stream 34 of the working fluid is passed through the first expander 18 to expand the first vaporized stream 34 of the working fluid and to drive a first generator unit (not shown). The first expander 18 may be an axial type expander, an impulse type expander, a high temperature screw type expander, or a radial-inflow turbine type of expander. After passing through the first expander 18, the first vaporized stream 34 of the working fluid at a relatively lower pressure and lower temperature is passed through the first heat exchanger 20 to the first condensing unit 22. The first vaporized stream 34 of the working fluid is condensed into a liquid, so as to generate a first condensed stream 36 of the working fluid. The first condensed stream 36 of the working fluid is then pumped using the first pump 24 to the second expander 26 via the first heat exchanger 20. The first heat exchanger 20 is configured to circulate the first vaporized stream 34 of the working fluid from the first expander 18 in heat exchange relationship with the first condensed stream 36 of the working fluid to heat the first condensed stream 36 of the working fluid and generate a second vaporized stream 38 of the working fluid.

In the cold system 16, the second vaporized stream 38 of the working fluid is passed through the second expander 26 to expand the second vaporized stream 38 of the working fluid and to drive a second generator unit (not shown). The second expander 26 may be an axial type expander, an impulse type expander, a high temperature screw type expander, or a radial-inflow turbine type of expander. After passing through the second expander 26, the second vaporized stream 38 of the working fluid is passed through the second heat exchanger 28 to the second condensing unit 30. The second vaporized stream 38 of the working fluid is condensed into a liquid, so as to generate a second condensed stream 40 of the working fluid. The second condensed stream 40 of the working fluid is then pumped using the second pump 32 to the heater 12 via the second heat exchanger 28. The second heat exchanger 28 is configured to circulate the second vaporized stream 38 of the working fluid from the second expander 26 in heat exchange relationship with the second condensed stream 40 of the working fluid to heat the second condensed stream 40 of the working fluid before being fed to the heater 12.

In the illustrated embodiment, there are two instances of heat exchange (may also be referred to as "intra-cycle" transfers of heat) between a high pressure stream of the working fluid and a low pressure stream of the working fluid. In the first instance, the first vaporized stream 34 of the working fluid is circulated in heat exchange relationship with the first condensed stream 36 of the working fluid to heat the first condensed stream 36 of the working fluid and generate a second vaporized stream 38 of the working fluid. This exchange of heat serves to boil (if the first condensed stream 36 of the working fluid is at sub-critical temperature) or otherwise increase the enthalpy (if the first condensed stream 36 of the working fluid is at supercritical temperature) of the pressurized first condensed stream 36 of the working fluid, so that the second vaporized stream 38 of the working fluid may then undergo another expansion in the second turbine 26. In the second instance, the second vaporized stream 38 of the working fluid from the second expander 26 is circulated in heat exchange relationship with the second condensed stream 40 of the working fluid to heat the second condensed stream 40 of the working fluid. The second condensed stream 40 of the working fluid is fed to the heater 12 and heated using the external heat source to complete the circuit of flow. The second heat exchanger 28 functions as a "recuperator" in the system 10.

In the illustrated embodiment, the working fluid includes carbon dioxide. The usage of carbon dioxide as the working fluid has the advantage of being non-flammable, non-corrosive, and able to withstand high cycle temperatures (for example above 400 degrees celsius). In one embodiment as described above, carbon dioxide may be heated super critically to substantially higher temperatures without risk of chemical decomposition. The two distinct intra-cycle transfers of heat following an initial expansion of the working fluid allows the working fluid to produce more work through successive expansions than that would be possible with a single expansion process (as in conventional Rankine cycle operation). In other embodiments, other working fluids are also envisaged.

Referring to FIG. 2, a portion of the hot system 14 (shown in FIG. 1) is disclosed. As discussed previously, after passing through the first expander, the first vaporized stream 34 of the working fluid at a relatively lower pressure and lower temperature is passed through the first heat exchanger 20 to the first condensing unit 22. The first condensing unit 22 is explained in greater detail herein. In the illustrated embodiment, the first condensing unit 22 is an air-cooled condensing unit. The first vaporized stream 34 of the working fluid exiting through the first heat exchanger 20 is passed via an air cooler 42 of the first condensing unit 22. The air cooler 42 is configured to cool the first vaporized stream 34 of the working fluid using ambient air.

In conventional systems, it is not be possible to condense carbon dioxide in many geographical locations if ambient air is employed as a cooling medium for a condenser, since ambient temperatures in such geographical locations routinely exceed critical temperature of carbon dioxide. In accordance with the embodiments of the present invention, carbon dioxide is completely condensed below its critical temperature, even if ambient temperatures in such geographical locations routinely exceed critical temperature of carbon dioxide.

In the illustrated embodiment, a first separator 44 is configured to separate a first uncondensed vapor stream 46 from the first condensed stream 36 of the working fluid exiting from the air cooler 42. One portion 48 of the first uncondensed vapor stream 46 is then expanded via a third expander 50. A second separator 52 is configured to separate a second uncondensed vapor stream 54 from the expanded one portion 48 of the first uncondensed vapor stream 46. The second uncondensed vapor stream 54 is circulated in heat exchange relationship with a remaining portion 56 of the first uncondensed vapor stream 46 via a third heat exchanger 58 so as to condense the remaining portion 56 of the first uncondensed vapor stream 46.

A compressor 60 is coupled to the third expander 50. The compressor 60 is configured to compress the second uncondensed vapor stream 54 from the third heat exchanger 58. The compressed second uncondensed vapor stream 54 is then fed to an upstream side of the air cooler 42. It should be noted herein that the first condensed stream 36 of the working fluid exiting via the first separator 44, a third condensed stream 62 of the working fluid exiting via the second separator 52, a fourth condensed stream 64 of the working fluid exiting via the third heat exchanger 58 are fed to the first pump 24. A pump 63 is provided to pump the third condensed stream 62 of the working fluid exiting via the second separator 52 to the first pump 24.

Referring to FIG. 3, a portion of the cold system 16 (shown in FIG. 1) is disclosed. As discussed previously, after passing through the second expander, the second vaporized stream 38 of the working fluid is passed through the second heat exchanger 28 to the second condensing unit 30. The second condensing unit 30 is explained in greater detail herein. In the illustrated embodiment, the second condensing unit 30 is an air-cooled condensing unit. The second vaporized stream 38 of the working fluid exiting through the second heat exchanger 28 is passed via an air cooler 66 of the second condensing unit 30. The air cooler 66 is configured to cool the second vaporized stream 38 of the working fluid using ambient air.

In the illustrated embodiment, a third separator 68 is configured to separate a second uncondensed vapor stream 70 from the second condensed stream 38 of the working fluid exiting from the air cooler 66. One portion 72 of the second uncondensed vapor stream 70 is then expanded via a fourth expander 74. A fourth separator 76 is configured to separate a third uncondensed vapor stream 78 from the expanded one portion 72 of the second uncondensed vapor stream 70. The third uncondensed vapor stream 78 is circulated in heat exchange relationship with a remaining portion 80 of the second uncondensed vapor stream 70 via a fourth heat exchanger 82 so as to condense the remaining portion 80 of the second uncondensed vapor stream 78.

A compressor 84 is coupled to the fourth expander 74. The compressor 84 is configured to compress the third uncondensed vapor stream 78 from the fourth heat exchanger 82. The compressed third uncondensed vapor stream 78 is then fed to an upstream side of the air cooler 66. It should be noted herein that the second condensed stream 38 of the working fluid exiting via the third separator 68, a fifth condensed stream 86 of the working fluid exiting via the fourth separator 76, a sixth condensed stream 88 of the working fluid exiting via the fourth heat exchanger 82 are fed to the second pump 32. A pump 87 is provided to pump the fifth condensed stream 86 of the working fluid exiting via the fourth separator 76 to the second pump 32.

With reference to the embodiments of FIGS. 2 and 3 discussed above, a portion of the working fluid e.g. carbon dioxide is diverted at each of the two condensing units 22, 30, to achieve condensation of the working fluid. In the event that the cooling ambient air becomes too warm to effect complete condensation of the working fluid, a portion of the uncondensed vapor is over expanded, so that the portion of the uncondensed vapor cools well below the saturation temperature, as well as the ambient air temperature. This cooled uncondensed vapor is then circulated in heat exchange relationship with the remaining fraction of the uncondensed vapor, which has not been over expanded, so as to condense the remaining fraction of uncondensed vapor into a liquid. The amount of uncondensed vapor to be diverted and over expanded may be adjusted until the amount of uncondensed vapor is sufficient to completely condense the undiverted fraction of the uncondensed vapor. The shaft work derived from the expansion process is applied to compress the over expanded fraction of the uncondensed vapor after having been heated by the condensation process. The compressed vapor stream is then recirculated to a point at an upstream side of the condensing unit.

Although, the above embodiments are discussed with reference to carbon dioxide as the working fluid, in certain other embodiments, other low critical temperature working fluids suitable for rankine cycle are also envisaged. As discussed herein, ensuring the availability of a cooling flow for the rankine cycle facilitates the availability of a cooling flow adequate to condense the working fluid as ambient cooling temperature rises during the summer season. In accordance with the exemplary embodiment, the condensing units and the low-pressure stage of the turbine are reduced in volume for rankine cycles employing carbon dioxide as the working fluid. Also, the exemplary rankine cycle has a compact footprint and consequently faster ramp-up time than rankine cycles employing steam as the working fluid.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A rankine cycle system, comprising:

a heater configured to circulate a working fluid in heat exchange relationship with a hot fluid to vaporize the working fluid;

a hot system coupled to the heater; wherein the hot system comprises a first heat exchanger configured to circulate a first vaporized stream of the working fluid from the heater in heat exchange relationship with a first condensed stream of the working fluid, thereby heating the first condensed stream to produce therefrom a second vaporized stream of the working fluid; and a cold system coupled to the heater and the hot system; wherein the cold system comprises a second heat exchanger configured to circulate the second vaporized stream of the working fluid from the hot system in heat exchange relationship with a second condensed stream of the working fluid to heat the second condensed stream of the working fluid before being fed to the heater.

2. The system of claim 1, wherein the hot system comprises a first expander configured to expand the first vaporized stream of the working fluid from the heater.

3. The system of claim 2, wherein the hot system comprises a first condensing unit configured to condense the expanded first vaporized stream of the working fluid fed from the heater via the first heat exchanger.

4. The system of claim 3, wherein the hot system comprises a pump configured to feed a condensed stream of the working fluid via the first heat exchanger to generate the second vaporized stream of the working fluid.

5. The system of claim 4, wherein the cold system comprises a second expander configured to expand the second vaporized stream of the working fluid from the first heat exchanger.

6. The system of claim 1 comprising a plurality of condensing units.

7. The system of claim 1 comprising a single pump.

8. The system of claim 1 comprising a plurality of pumps.

9. The system of claim 1 comprising two and only two expanders.

10. The system of claim 1 comprising a plurality of expanders.

11. The system of claim 1, wherein the cold system comprises a pump configured to feed the second condensed stream of the working fluid via the second heat exchanger to the heater.

12. The system of claim 1, wherein the working fluid comprises carbon dioxide.

13. The system of claim 1, wherein the hot fluid comprises an exhaust gas.

14. A method, comprising:

circulating a working fluid in heat exchange relationship with a hot fluid via a heater to vaporize the working fluid;

circulating a first vaporized stream of the working fluid from the heater in heat exchange relationship with a first condensed stream of the working fluid via a first heat exchanger of a hot system, thereby heating the first condensed stream of the working fluid to produce a second vaporized stream of the working fluid therefrom; and circulating the second vaporized stream of the working fluid from the hot system in heat exchange relationship with a second condensed stream of the working fluid via a second heat exchanger of a cold system to heat the second condensed stream of the working fluid before being fed to the heater.

15. The method of claim 14, wherein the first and second condensed streams of the working fluid are produced from separate condensing units.

16. The method of claim 14, wherein the working fluid is carbon dioxide.

17. The method of claim 14, further comprising expanding the first vaporized stream of the working fluid from the heater via a first expander of the hot system.

18. The method of claim 17, further comprising condensing the expanded first vaporized stream of the working fluid via a first condensing unit of the hot system.

19. The method of claim 18, further comprising expanding the second vaporized stream of the working fluid from the first heat exchanger via a second expander of the cold system.

20. The method of claim 19, further comprising condensing the expanded second vaporized stream of the working fluid via a second condensing unit of the cold system.

* * * * *